US007871285B1

(12) United States Patent
Tobey et al.

(10) Patent No.: US 7,871,285 B1
(45) Date of Patent: Jan. 18, 2011

(54) METHODS AND APPARATUS FOR TERMINATING ELECTRICAL CONNECTORS TO CABLES

(75) Inventors: Shawn Phillip Tobey, Trinity, NC (US); Paul John Pepe, Clemmons, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/644,672

(22) Filed: Dec. 22, 2009

(51) Int. Cl.
*H01R 11/20* (2006.01)

(52) U.S. Cl. ..... 439/392

(58) Field of Classification Search ..... 439/392, 439/404, 405, 417, 676
See application file for complete search history.

(56) References Cited

U.S. PATENT DOCUMENTS 3,860,319 A * 1/1975 Slater ..... 439/400
5,951,330 A 9/1999 Reichard, Jr. et al.
6,238,231 B1 5/2001 Chapman et al.
6,872,090 B2 3/2005 De Dios Martin
7,384,298 B2 * 6/2008 Caveney et al. ..... 439/404
7,575,482 B1 * 8/2009 Pepe et al. ..... 439/676
2010/0064503 A1 * 3/2010 Chen ..... 29/566.4

* cited by examiner

*Primary Examiner*—Phuong K Dinh

(57) ABSTRACT

An electrical connector includes a front housing holding a plurality of contacts and holding a cutting blade proximate to a rear of the front housing. The electrical connector also includes a rear housing having a wire organizer at a front of the rear housing that has a plurality of wire channels configured to receive corresponding wires therein. The rear housing has an outer support wall spaced apart from, and arranged outward of, the wire channels, where the outer support wall has a front edge. The wire channels extending along wire channel axes that extend across the front edge. During mating of the rear housing with the front housing, the cutting blade is configured to trim the wires extending from the wire organizer and is positioned between the outer support wall and the wire organizer. The wires are terminated to the contacts when the front housing and the rear housing are mated.

20 Claims, 4 Drawing Sheets

METHODS AND APPARATUS FOR TERMINATING ELECTRICAL CONNECTORS TO CABLES

BACKGROUND OF THE INVENTION

The subject matter herein relates generally to electrical connectors, and more particularly to methods and apparatus for terminating electrical connectors to cables.

Various electronic systems, such as those used to transmit signals in the telecommunications industry, include connector assemblies with electrical wires arranged in differential pairs. One wire in the differential pair carries a positive signal and the other wire carries a negative signal intended to have the same absolute magnitude, but at an opposite polarity. An RJ-45 electrical connector is one example of a connector used to transmit electrical signals in differential pairs.

In an effort to improve the efficiency and convenience of terminating the electrical connector to a cable, wire lacing features and cutting blades are being integrated into the electrical connector. Such configurations allow the wires to be terminated and trimmed without the need for a separate lacing fixture tool. Electrical connectors that utilize such features are not without disadvantages. For instance, known electrical connectors that include cutting blades only support the wires on one side of the cutting blade during the trimming process. The wires are therefore supported in a cantilevered beam configuration and are susceptible to being deflected instead of having a clean cut. This condition is worsened with dulled cutting blades or if a gap exists between the wire support and the cutting blade. As such, cutting blades made from very hard metals are used, which increases the overall cost of the electrical connector. Additionally, the connector assemblies are being manufactured to very tight tolerances to ensure that no gaps exist between the cutting blade and the support wall. Such manufacturing concerns increase the overall cost of the electrical connectors. Moreover, wires that are not cut clean and that have been deflected result in stretched and exposed conductors that could potentially lead to electrical shorting between components and or degradation of transmission performance and return loss.

A need remains for an electrical connector that may provide proper support for wires during the trimming process.

BRIEF DESCRIPTION OF THE INVENTION

In one embodiment, an electrical connector is provided that includes a front housing holding a plurality of contacts and holding a cutting blade proximate to a rear of the front housing. The electrical connector also includes a rear housing having a wire organizer at a front of the rear housing that has a plurality of wire channels that receive corresponding wires therein. The rear housing has an outer support wall spaced apart from, and arranged outward of, the wire channels, where the outer support wall has a front edge. The wire channels extend along wire channel axes that extend across the front edge. During mating of the rear housing with the front housing, the cutting blade trims wires extending from the wire organizer and is positioned between the outer support wall and the wire organizer. The wires are terminated to the contacts when the front housing and the rear housing are mated.

In another embodiment, an electrical connector is provided including a front housing holding a plurality of contacts and having a top ledge and a bottom ledge at a rear of the front housing. The front housing has a top cutting blade extending rearward from the top ledge and a bottom cutting blade extending rearward from the bottom ledge. The electrical connector also includes a rear housing having a wire organizer at a front of the rear housing, with a plurality of wire channels that receive corresponding wires therein. The rear housing also has an upper support wall and a lower support wall extending forward therefrom, with the upper support wall being spaced apart from the wire organizer such that a first slot is formed therebetween, and with the lower support wall being spaced apart from the wire organizer such that a second slot is formed therebetween. A first set of the wires extends from the wire channels across the first slot to the upper support wall, and a second set of the wires extending from the wire channels across the second slot to the lower support wall. The top cutting blade is positioned in the first slot and the bottom cutting blade is positioned in the second slot. The top cutting blade trims the first set of wires as the front and rear housings are mated, and the bottom cutting blade trims the second set of wires as the front and rear housings are mated. The first and second sets of wires are terminated to the contacts when the front and rear housings are mated.

In a further embodiment, an electrical connector is provided including a front housing holding a plurality of contacts and holding a cutting blade proximate to a rear of the front housing. The electrical connector also includes a rear housing having a central opening configured to receive a multi-wire cable therethrough along a cable axis. The rear housing has an inner support wall and an outer support wall positioned along a front of the rear housing, with the outer support wall being spaced apart from, and radially outward of, the inner support wall such that a slot is created between the inner and outer support walls. Individual wires of the cable extending across the slot such that each wire is supported on a rear surface thereof by both the inner and outer support walls. The cutting blade is positioned in the slot. The cutting blade trims the wires between the inner and outer support walls. The wires are terminated to the contacts when the front housing and the rear housing are mated. Optionally, the wires may enter the rear housing through the central opening along the cable axis and the wires may be bent about the front of the rear housing such that the wires extend generally perpendicular to the cable axis.

DETAILED DESCRIPTION OF THE INVENTION

Figure 1:
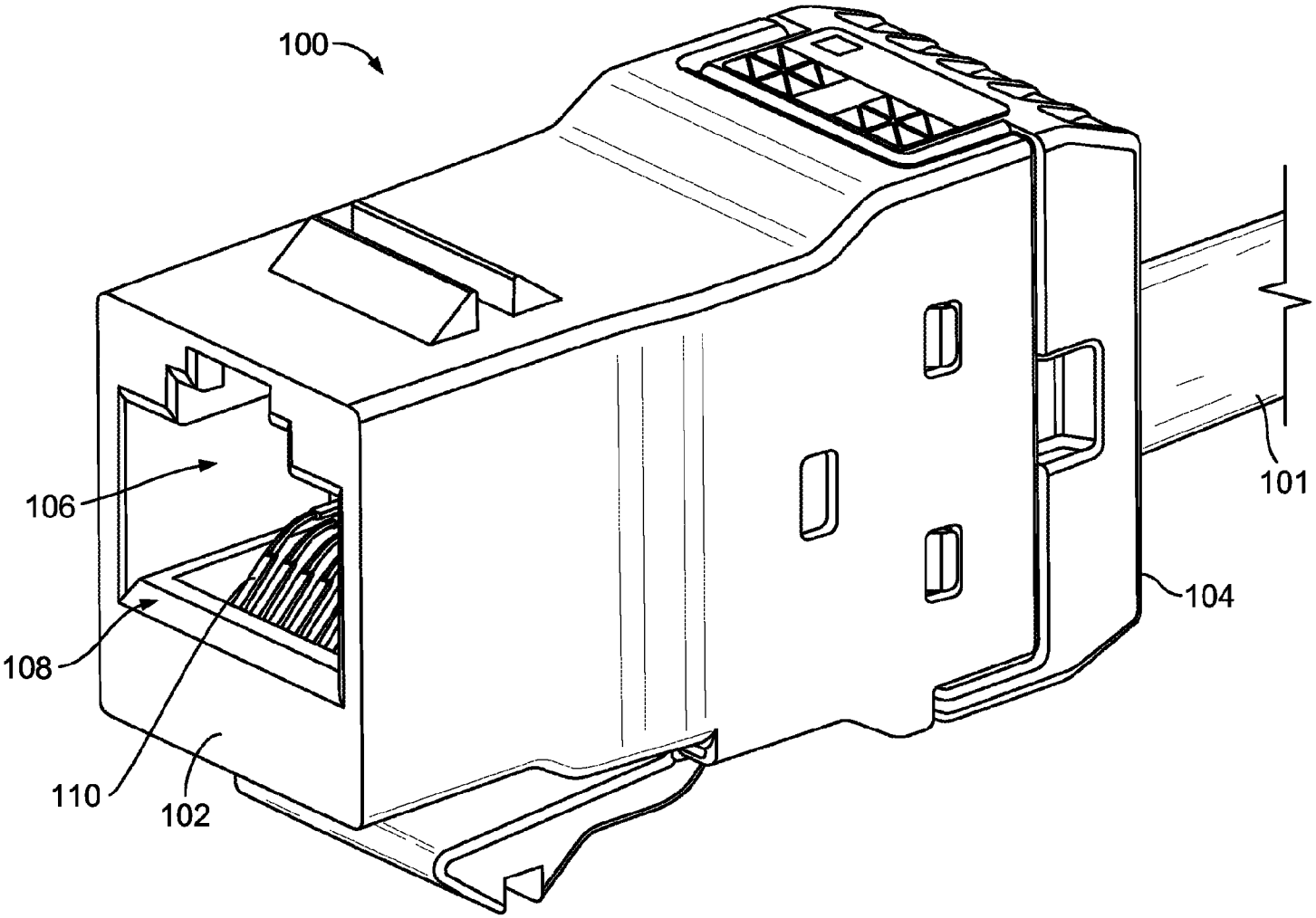
FIG. 1 is a front perspective view of an electrical connector formed in accordance with an exemplary embodiment.

FIG. 1 is a front perspective view of an electrical connector formed in accordance with an exemplary embodiment. The electrical connector 100 is illustrated as an RJ-45 jack or receptacle, however the subject matter described herein may be used with other types of electrical connectors. The RJ-45 jack is thus merely illustrative. The electrical connector 100 is provided at the end of a cable 101. In an exemplary embodiment, the cable 101 includes multiple wires, arranged in differential pairs, such as in a twisted wire pair configuration.

The electrical connector 100 has a front or mating end 102 and a wire termination end 104. A mating cavity 106 is provided at the mating end 102 and is configured to receive a mating connector (not shown) therein. A mating end opening 108 is also provided at the mating end 102 that provides access to the mating cavity 106. Jack contacts 110 are arranged within the mating cavity 106 in an array for mating engagement with mating contacts (not shown) of the mating connector. In the example of FIG. 1, the mating cavity 106 accepts an RJ-45 plug (not shown) inserted through the mating end opening 108. The RJ-45 plug has mating contacts which electrically interface with the array of jack contacts 110.

Figure 2:
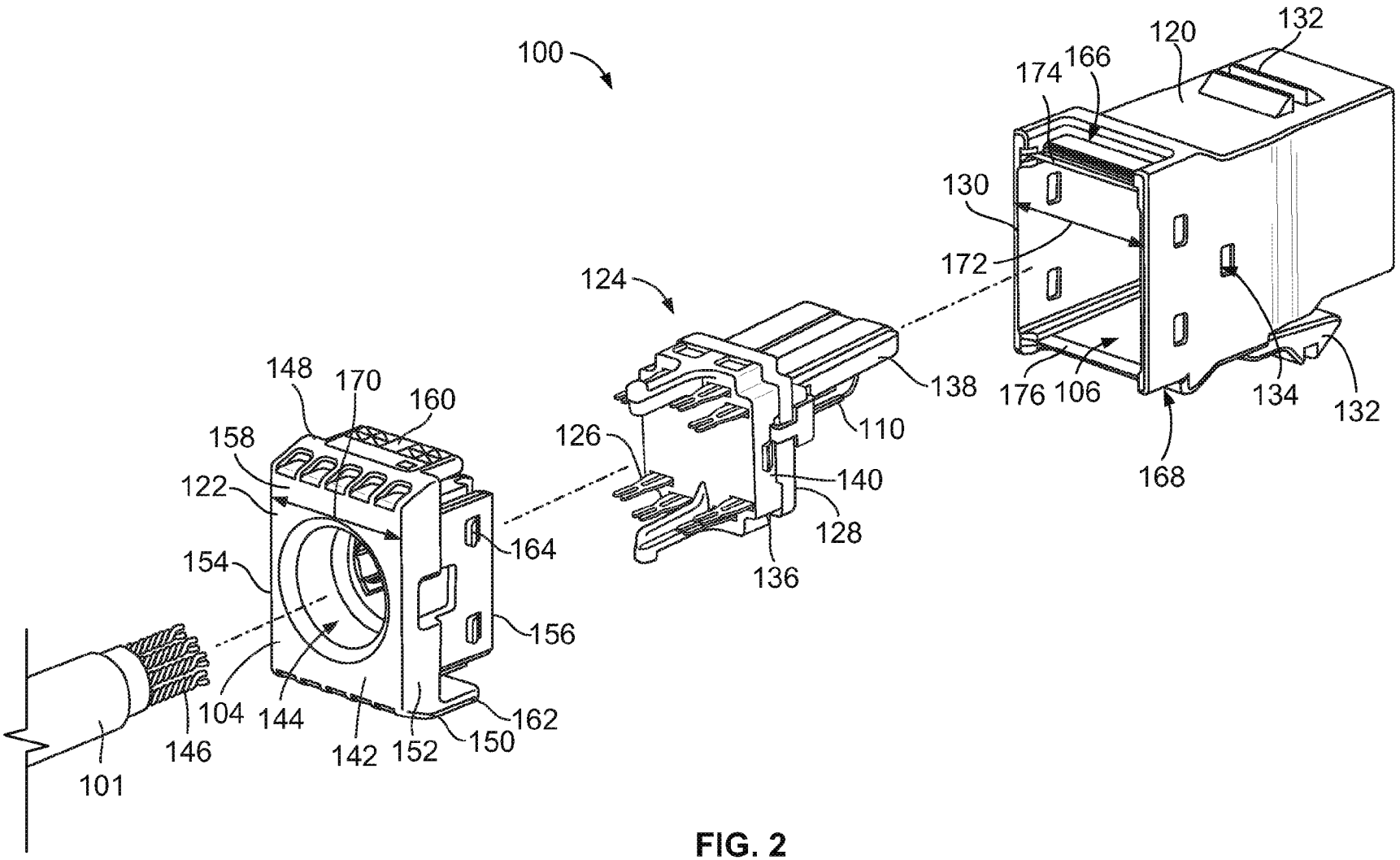
FIG. 2 is a rear, exploded view of the electrical connector shown in FIG. 1.

FIG. 2 is a rear, exploded view of the electrical connector 100. The electrical connector 100 includes a front housing 120, a rear housing 122, and a contact sub-assembly 124 that is configured to be received in the front housing 120. The contact sub-assembly 124 includes the jack contacts 110 as well as wire termination contacts 126, which are electrically connected to corresponding jack contacts 110. Optionally, the jack contacts 110 may be indirectly coupled to the wire termination contacts 126, such as by a conductive path created through a circuit board 128 that electrically interconnects the jack contacts 110 and the wire termination contacts 126. Alternatively, the jack contacts 110 may be directly coupled to the wire termination contacts 126, or the jack contacts 110 may be integrally formed with the wire termination contacts 126.

The front housing 120 is generally box-shaped, however the front housing 120 may have any shape depending on the particular application. The front housing 120 extends between the mating end 102 and a rear 130 of the front housing 120. The mating cavity 106 extends at least partially between the mating end 102 and the rear 130 of the front housing 120. The front housing 120 is fabricated from a dielectric material, such as a plastic material. Alternatively, the front housing 120 may be shielded, such as by being fabricated from a metal material or a metalized plastic material, or by having a shield element attached thereto and/or surrounding select portions of the front housing 120. In one embodiment, the front housing 120 includes one or more latches 132 for mounting to a wall panel. The front housing 120 also includes slots 134 in side walls of the front housing 120.

The contact sub-assembly 124 includes the circuit board 128 and a substrate 136 mounted to the circuit board 128. The substrate 136 holds the wire termination contacts 126. A contact support 138 extends from one side of the circuit board 128 opposite the substrate 136. The jack contacts 110 are terminated to the circuit board 128 and are supported by the contact support 138. Optionally, the jack contacts 110 may include pins that are through-hole mounted to the circuit board 128, or the jack contacts 110 may be soldered to the circuit board 128. Alternatively, in lieu of the circuit board 128, the jack contacts 110 may be supported by the substrate 136 for direct mating with the wire termination contacts 126 or for direct mating with the wires of the cables. The contact sub-assembly 124 is received in the front housing 120 such that the jack contacts 110 are exposed within the mating cavity 106.

The wire termination contacts 126 are illustrated as being insulation displacement contacts, however any type of contacts may be provided for terminating to the individual wires of the cable 101. The wire termination contacts 126 are configured to be electrically and mechanically coupled to the circuit board 128 of the contact sub-assembly 124 when the electrical connector 100 is assembled. For example, the wire termination contacts 126 may include pins that project forward from the substrate 136 into through-holes in the circuit board 128. Traces routed along the circuit board 128 connect the wire termination contacts 126 with the jack contacts 110. The wire termination contacts 126 may be press-fit or soldered to the through-holes in the circuit board 128. When assembled, the substrate 136 is coupled to the rear 130 of the front housing 120. In an exemplary embodiment, the substrate 136 includes tabs 140 on the sides thereof that are received in the slots 134 in the front housing 120 to secure the contact sub-assembly 124 and substrate 136 to the front housing 120.

The rear housing 122 is configured to be coupled to the front housing 120 during assembly. When the electrical connector 100 is assembled, the rear housing 122 defines an end cap at the wire termination end 104 of the electrical connector 100. The rear housing 122 includes an end wall 142 defining the wire termination end 104. The rear housing 122 also includes an opening 144 extending therethrough that is configured to receive the cable 101. The opening 144 extends transversely through the end wall 142. The rear housing 122 is configured to receive and hold the cable 101 and the individual wires 146 of the cable 101. In an exemplary embodiment, the rear housing 122 provides strain relief between the electrical connector 100 and the cable 101. The rear housing 122 may include features that securely grip the cable 101 to hold the relative position of the rear housing 122 with respect to the cable 101. The rear housing 122 may include a ferrule that extends rearward from the end wall 142 along the cable 101 to provide strain relief.

The rear housing 122 includes a top 148, a bottom 150, opposite sides 152, 154, a front 156 and a rear 158 opposite the front 156. In an exemplary embodiment, the end wall 142 defines the rear 158. The rear housing 122 includes an upper support wall 160 along the top 148 and a lower support wall 162 along the bottom 150. The upper and lower support walls 160, 162 define exterior walls of the rear housing 122 and may define exterior walls of the electrical connector 100. The sides 152, 154 include tabs 164 that extend outward therefrom. The tabs 164 are configured to be received in slots 134 in the front housing 120 to secure the rear housing 122 to the front housing 120.

The front housing 120 includes a top channel 166 and a bottom channel 168 at the rear 130 of the front housing 120. The upper and lower support walls 160, 162 of the rear housing 122 are configured to be received in the top and bottom channels 166, 168, respectively, when the rear housing 122 is mated with the front housing 120. The rear housing 122 has a width 170 defined between the sides 152, 154 that is substantially equal to a width 172 of the front housing 120. In an exemplary embodiment, the upper and lower support walls 160, 162 each have different widths. For example, the lower support wall 162 may extend from the side 152 to the side 154 such that the lower support wall 162 has a width substantially the same as the width 170 of the rear housing 122. The sides of the upper support wall 160 may be recessed from the side 152 and/or the side 154 such that the upper support wall 160 has a width that is less than the width 170 of the rear housing 122 and/or the lower support wall 162. As such, the upper and lower support walls 160, 162 may be sized differently than one another. Similarly, the top and bottom channels 166, 168 may be sized differently than one another to accommodate the upper and lower support walls 160, 162, respectively. Because of the size differences, the upper and lower support walls 160, 162 and the top and bottom channels 166, 168 may operate as polarizing features for the front and rear housings 120, 122. For example, the lower support wall 162 may be sized larger than the upper channel 166 such that the lower support wall 162 cannot fit into the top channel 166. Because the upper and lower support walls 160, 162 define an exterior surface of the electrical connector 100, proper orientation of the rear housing 122 with respect to the front housing 120 will be visually apparent to the person assembling the electrical connector 100.

The front housing 120 includes a top cutting blade 174 and a bottom cutting blade 176 at the rear 130 of the front housing 120. The top and bottom cutting blades 174, 176 are configured to trim the wires 146 during assembly of the rear housing 122 and the front housing 120. For example, the wires 146 may be held by the rear housing 122 such that, as the rear housing 122 is loaded into the front housing 120, the cutting blades 174, 176 slice through the wires 146. The cutting blades 174, 176 are an integral part of the front housing 120 and remains attached to the front housing 120 after the electrical connector 100 is assembled. The cutting blades 174, 176 operate to trim the wires 146 during assembly of the connector, such that the wires 146 do not need to be trimmed by a separate tool or device prior to mating the rear housing 122 with the front housing 120.

Figure 3:
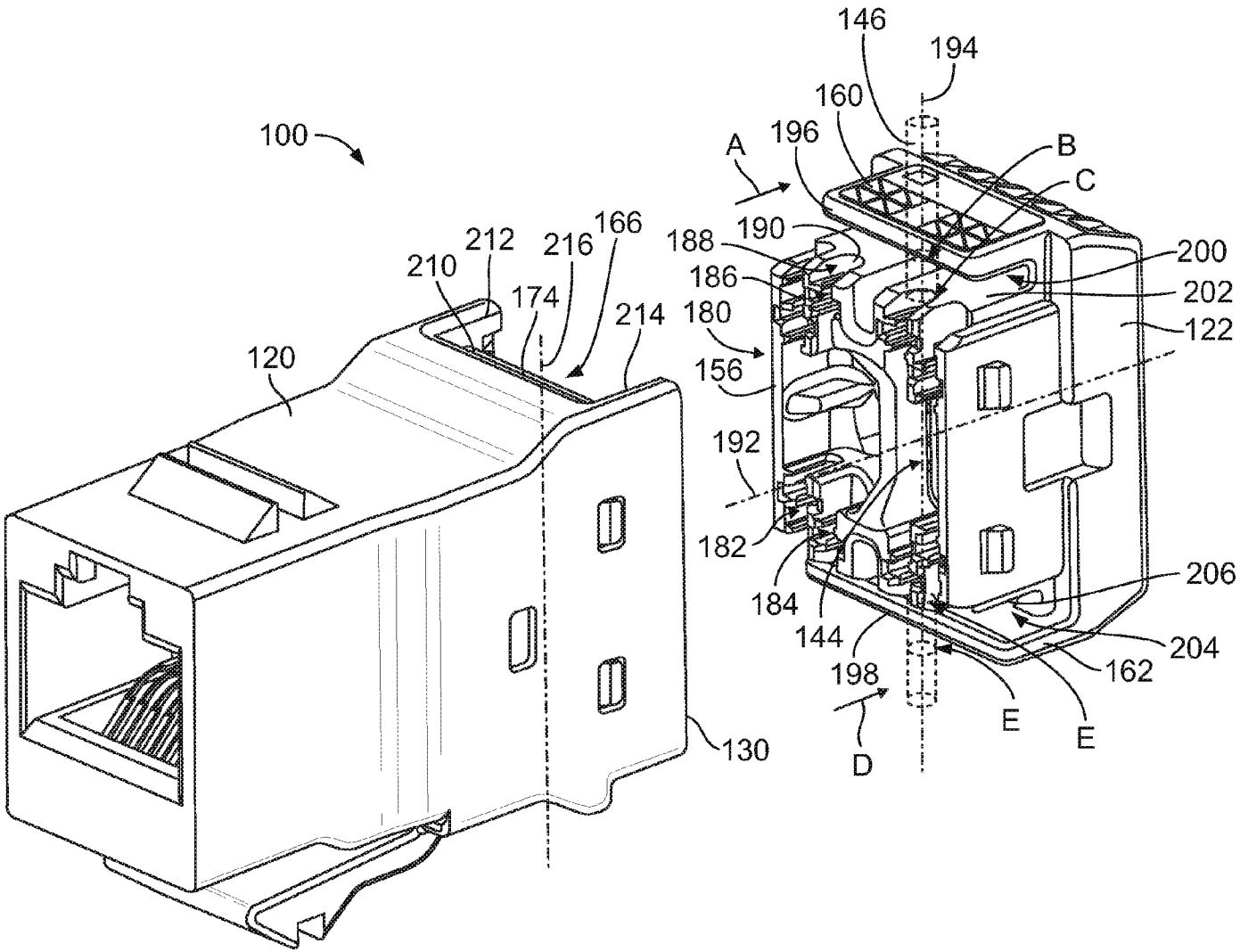
FIG. 3 is a front, exploded view of the electrical connector shown in FIG. 1.

FIG. 3 is a front, exploded view of the electrical connector 100 with the rear housing 122 positioned for mating with the front housing 120. The contact subassembly 124 (shown in FIG. 2) is shown loaded into the front housing 120.

A wire organizer 180 is included at the front 156 of the rear housing 122. The wire organizer 180 includes a plurality of wire channels 182 that receive individual ones of the wires 146 (shown in phantom). The wire channels 182 hold the wires 146 in predetermined positions for mating with the wire termination contacts 126 (shown in FIG. 2) as the rear housing 122 is mated with the front housing 120. The wire organizer 180 may be used in lieu of a wire lacing device that would separately terminate the wires 146 to the contact subassembly 124 during an assembly step that is different than the step of mating the rear housing 122 with the front housing 120. The wire organizer 180 is an integral part of the rear housing 122 and remain with the rear housing 122 after the electrical connector 100 is assembled. The wire organizer 180 holds the wires 146 such that the wires 146 may be terminated to the wire termination contacts 126 during the same assembly step as the rear housing 122 being mated with the front housing 120.

In the illustrated embodiment, the wire organizer 180 includes four wire channels 182 in an upper row and four wire channels 182 in a lower row. The wire channels 182 receive the wires 146 in accordance with a predetermined wire layout. For example, the wires 146 may be part of wire pairs that carry differential signals and must be laid out in a predetermined pattern. Each of the wire channels 182 include a contact slot 184 that receives a corresponding wire termination contact 126. Optionally, the contact slots 184 may be staggered and offset with respect adjacent contact slots 184.

The wire channels 182 are exposed by an opening 186 at the front 156 of the rear housing 122. The wire channels 182 have walls 188 that extend from the opening 186 to a back 190 of the wire channel 182. During assembly, the cable 101 (shown in FIG. 2) is passed through the opening 144 along a cable axis 192. Portions of the individual wires 146 are exposed and, where needed, untwisted. The wires 146 are then bent either upward or downward to the corresponding wire channels 182. The wires 146 are loaded into the wire channels 182 through the opening 186 until the wires 146 rest against the back 190 of the wire channel 182. Once positioned in the wire channels 182, the wires 146 generally extend along wire channel axes 194 that are substantially perpendicular to the cable axis 192.

In an exemplary embodiment, the upper and lower support walls 160, 162 are cantilevered forward, and extend to a front edge 196, 198, respectively. The front edges 196, 198 define support surfaces for the wires 146 when the wires 146 are laced into the wire organizer 180. In an exemplary embodiment, the front edges 196, 198 are substantially coplanar with the backs 190 of the wire channels 182. As such, the wires 146 may extend vertically out of the wire channels straight across the front edges 196, 198. Optionally, the front edges 196, 198 may include grooves or slots that receive and/or position the wires 146. The grooves may be curved and/or may include fingers that securely hold the wires 146 within the grooves. In an alternative embodiment, the upper and lower support walls 160, 162 may include openings that receive individual wires 146, rather than wires 146 resting on the front edges 196, 198. The openings may be substantially aligned with the wire channels 182. In an alternative embodiment, the front edges 196, 198 may be positioned either forward of or rearward of the backs 190 of the channels 182 such that the front edges 196, 198 are non-coplanar with the backs 190. Optionally, the front edges 196, 198 may be non-coplanar with one another, such as to define a polarizing feature for proper orientation of the rear housing 122 with the front housing 120.

The upper and lower support walls 160, 162 are spaced apart from the wire organizer 180, vertically above and vertically below, respectively, the wire organizer 180. A first slot 200 is defined between the upper support wall 160 and a top 202 of the wire organizer 180. A second slot 204 is defined between the lower support wall 162 and a bottom 206 of the wire organizer 180. The slots 200, 204 define spaces that receive the cutting blades 174, 176 (shown in FIG. 2) when the rear housing 122 is mated with the front housing 120.

For a wire 146 that is laced to the top of the rear housing 122, the upper support wall 160 defines an outer support wall for the wire 146 and the wire organizer 180 defines an inner support wall for the wire 146. More specifically, a first or outer portion of the wire 146 is supported by the front edge 196 against rearward movement in a rearward direction, shown by the arrow A, and a second or inner portion of the wire 146 is supported by the back 190 of the wire channel 182 at the top 202. For example, the wire 146 is supported at point B and point C against rearward movement in the rearward direction A. As such, the wire 146 may be supported along two different lengths of the wire 146, namely by the wire channel 182 and the front edge 196 of the outer support wall 160. Because the wire 146 is supported against movement in the rearward direction A radially outward of the cutting blade 174 (e.g. vertically above the cutting blade 174), the distal end of the wire 146 is restricted from moving in the rearward direction. The extra support tends to hold the wire 146 in place during the trimming process much more reliably than if the wire 146 were only supported at the wire channel 182 (point C) and cantilevered from that point, where the wire 146 would tend to deflect rearwardly when engaged by the cutting blade 174 during the trimming process. Such deflection may lead to wires 146 that are not cut clean and result in stretched and exposed conductors that could potentially lead to electrical shorting between components and or degradation of transmission performance and return loss. However, by adding support vertically above the top cutting blade 174, the distal end of the wire 146 is supported against movement in the rearward direction. When the rear housing 122 is mated with the front housing 120, the top cutting blade 174 trims the wire 134 between the two supported lengths of the wire 146 (e.g.

between point B and point C). Once trimmed, the portion of the wire 146 engaging the front edge 196 of the outer support wall 160 is removed.

For a wire 146 that is laced to the bottom of the rear housing 122, the lower support wall 162 defines an outer support wall for the wire 146 and the wire organizer 180 defines an inner support wall for the wire 146. More specifically, an outer portion of the wire 146 is supported by the front edge 198 against rearward movement in a rearward direction, shown by the arrow D, and an inner portion of the wire 146 is supported by the back 190 of the wire channel 182 at the bottom 206. For example, the wire 146 is supported at point E and point F against rearward movement in the rearward direction D. As such, the wire 146 may be supported along two different lengths of the wire 146, namely by the wire channel 182 and the front edge 198 of the outer support wall 162. Because the wire 146 is supported against movement in the rearward direction D radially outward of the cutting blade 176 (e.g. vertically below the cutting blade 176), the distal end of the wire 146 is restricted from moving in the rearward direction. The extra support tends to hold the wire 146 in place during the trimming process much more reliably than if the wire 146 were only supported at the wire channel 182 (point F) and cantilevered from that point. By adding support vertically below the bottom cutting blade 176, the distal end of the wire 146 is supported against movement in the rearward direction. When the rear housing 122 is mated with the front housing 120, the bottom cutting blade 176 trims the wire 134 between the two supported lengths of the wire 146 (e.g. between point E and point F). Once trimmed, the portion of the wire 146 engaging the front edge 198 of the outer support wall 162 is removed.

The top channel 166 is open at the rear 130 of the front housing 130, such that the channel 166 has an open rear. The channel 166 also includes an open top. The channel 166 is defined by a front wall 210 and opposite side walls 212, 214. The channel is sized to receive the upper support wall 160 of the rear housing 120 such that the upper support wall 160 engages the side walls 212, 214 to resist rotation of the rear housing 122 with respect to the front housing 120. For example, when the cable 101 is pulled side to side, the upper support wall 160 may interfere with one of the side walls 212, 214 to resist side to side movement of the rear housing 122. In other words, the interference between the upper support wall 160 and the side walls 212, 214 resists rotation of the rear housing 122 about a rotation axis 216 that is parallel to the wire channel axes 194.

Figure 4:
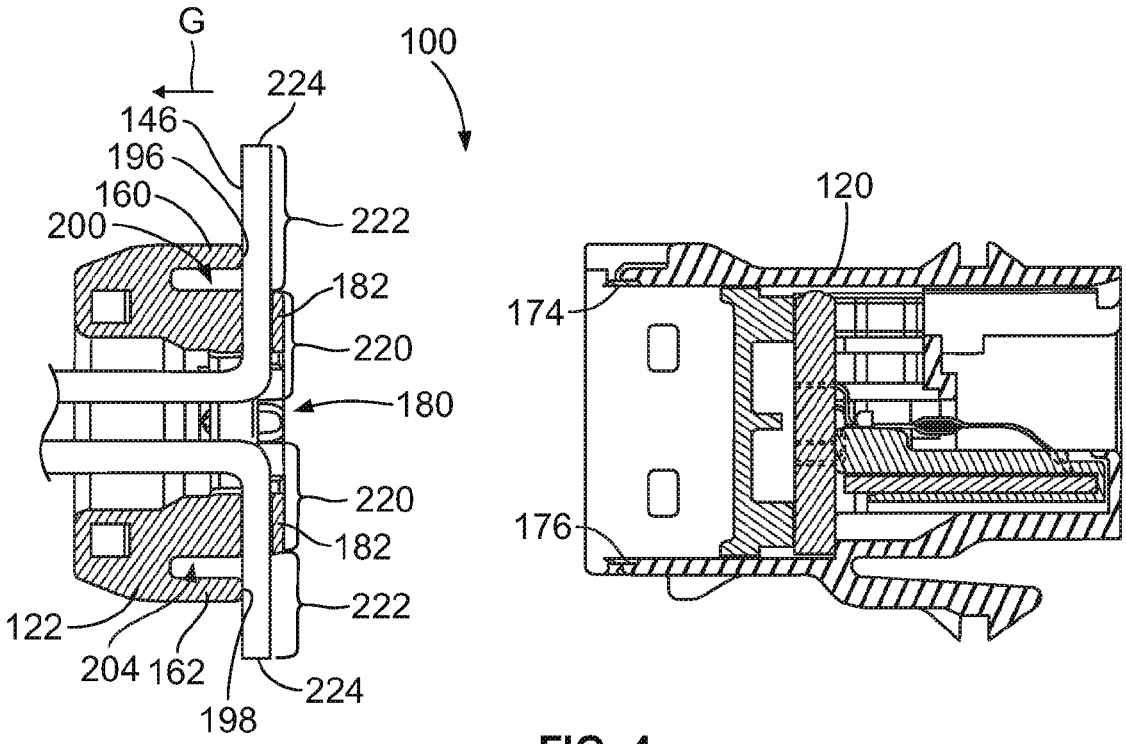
FIG. 4 is a cross-sectional view of the electrical connector in an unassembled state.

FIG. 4 is a cross-sectional view of the electrical connector 100 in an unassembled state illustrating wires 146 held in the wire organizer 180 and supported by the upper and lower support walls 160, 162. Each wire 146 has a first portion 220 and a second portion 222. The second portion 222 is defined between the first portion 220 and a distal end 224 of the wire 146. The first portion 220 is supported by the inner support wall, represented by the wire channel 182, against movement in the rearward direction, shown by the arrow G. The second portion 222 is supported by the corresponding outer support wall, represented by the upper and lower support walls 160, 162, against movement in the rearward direction G. The second portion 222 is configured to be trimmed by the corresponding cutting blade 174, 176 and removed from the first portion 220 when the front and rear housings 120, 122 are mated.

The slots 200, 204 are defined between the wire organizer 180 and the upper and lower support walls 160, 162, respectively. The wires 146 span across the slots 200, 204 in line with the cutting blades 174, 176 such that the cutting blades 174, 176 slice through the wires 146 when the front and rear housings 120, 122 are mated. For the upper wire 146, the wire 146 is supported on one side of the slot 200 by the wire channel 182 and on the other side of the slot 200 by the front edge 196 of the upper support wall 160. The top cutting blade 174 is configured to be received in the slot 200 when the front and rear housings 120, 122 are mated. The wire 146 is supported vertically above the location where the wire 146 is to be sliced by the cutting blade 174. For the lower wire 146, the wire 146 is supported on one side of the slot 204 by the wire channel 182 and on the other side of the slot 204 by the front edge 198 of the lower support wall 162. The bottom cutting blade 176 is configured to be received in the slot 204 when the front and rear housings 120, 122 are mated. The wire 146 is supported vertically below the location where the wire 146 is to be sliced by the cutting blade 176.

Figure 5:
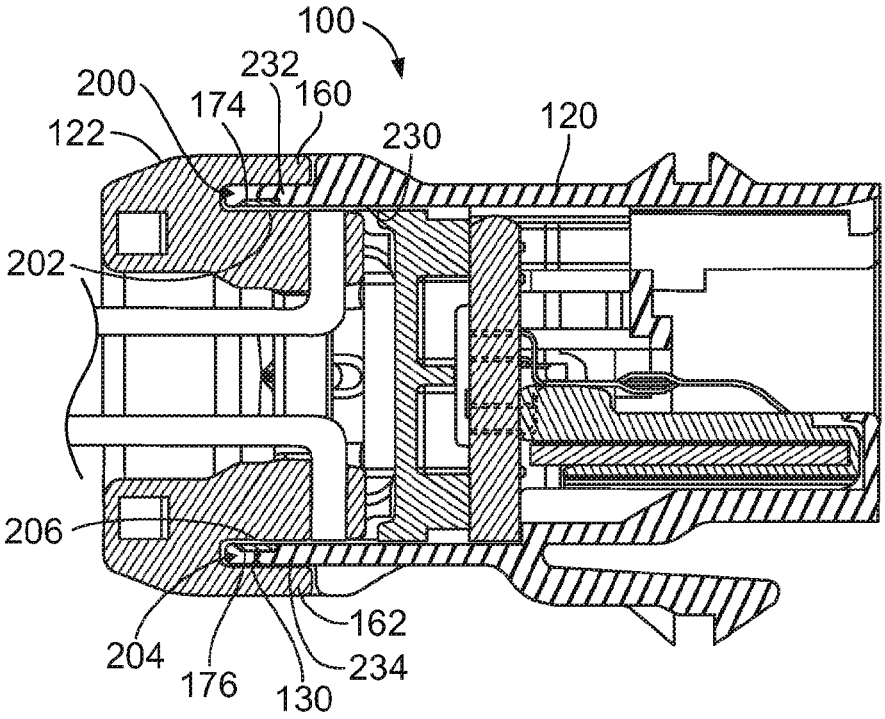
FIG. 5 is a cross-sectional view of the electrical connector in an assembled state.

FIG. 5 is a cross-sectional view of the electrical connector 100 in an assembled state with the rear housing 122 mated to the front housing 120. When the electrical connector 100 is assembled, the wire organizer 180 is received in the back end of the front housing 120. The wires 146 are cut clean and the second portions 222 (shown in FIG. 4) have been removed. The ends of the wires 146 generally face an interior surface 230 of the front housing 120.

The cutting blades 174, 176 are mounted to top and bottom ledges 232, 234, respectively, at the rear 130 of the front housing 120. The top ledge 232 and top cutting blade 174 are received in the first slot 200 between the inner support wall defined by the top 202 of the wire organizer 180 and the outer support wall defined by the upper support wall 160. The bottom ledge 234 and the bottom cutting blade 176 are received in the second slot 204 between the inner support wall defined by the bottom 206 of the wire organizer 180 and the outer support wall defined by the lower support wall 162. The cutting blades 174, 176 are positioned rearward of the wires 146 so that the wires 146 do not electrically contact the cutting blades 174, 176, which could create an electrical short.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a front housing holding a plurality of contacts, the front housing holding a cutting blade proximate to a rear of the front housing; and a rear housing having a wire organizer at a front of the rear housing, the wire organizer having a plurality of wire channels configured to receive corresponding wires therein, the rear housing having an outer support wall spaced apart from, and arranged outward of, the wire channels, the outer support wall having a front edge, the wire channels extending along wire channel axes that extend across the front edge;

wherein the cutting blade is configured to trim the wires extending from the wire organizer during mating of the rear housing with the front housing, the cutting blade being positioned between the outer support wall and the wire organizer and the wires being terminated to the contacts when the front housing and the rear housing are mated.

2. The electrical connector of claim 1, wherein the wire is supported along two different lengths of the wire by the wire channels and the front edge of the outer support wall, respectively, the cutting blade trimming the wire between the two supported lengths of the wire.

3. The electrical connector of claim 1, wherein, during mating of the rear housing with the front housing, the cutting blade is loaded in a mating direction transverse to the wire channel axes, the outer support wall supporting a distal end of the wire against movement in the mating direction.

4. The electrical connector of claim 1, wherein a slot is defined between the wire organizer and the outer support wall, the wire spans across the slot and is supported on one side of the slot by the wire channel, the wire being supported on the other side of the slot by the front edge of the outer support wall, the cutting blade being received in the slot when the front and rear housings are mated, the cutting blade cutting through the wire as the cutting blade is loaded into the slot.

5. The electrical connector of claim 1, wherein each wire has a first portion and a second portion, the second portion being defined between the first portion and a distal end of the wire, the first portion being supported by the corresponding wire channel against movement in a rearward direction, the second portion being supported by the outer support wall against movement in the rearward direction, the second portion being trimmed by the cutting blade and removed from the first portion when the front and rear housings are mated.

6. The electrical connector of claim 1, wherein a portion of the wire engaging the front edge of the outer support wall is removed after the cutting blade trims the wire.

7. The electrical connector of claim 1, wherein, during mating of the rear housing with the front housing, the cutting blade is loaded in a mating direction transverse to the wire channel axes, each of the wires being supported against movement in the mating direction radially outward of the cutting blade.

8. The electrical connector of claim 1, wherein the wire channels are open at a front thereof and the wire channels have a back opposite the open front, the wires being supported against movement in the rearward direction by the back of corresponding wire channels, the front edge of the outer support wall being substantially coplanar with the backs of the wire channels.

9. The electrical connector of claim 1, wherein the front housing includes a channel being open at the rear of the front housing, the channel being defined by a front wall and opposite side walls, the channel being sized to receive the outer support wall such that the outer support wall engages the side walls to resist rotation of the rear housing with respect to the front housing about an axis parallel to the wire channel axes.

10. An electrical connector comprising:

a front housing holding a plurality of contacts, the front housing having a top ledge and a bottom ledge at a rear of the front housing, the front housing having a top cutting blade extending rearward from the top ledge and a bottom cutting blade extending rearward from the bottom ledge; and a rear housing having a wire organizer at a front of the rear housing, the wire organizer having a plurality of wire channels that receive corresponding wires therein, the rear housing having an upper support wall and a lower support wall extending forward therefrom, the upper support wall being spaced apart from the wire organizer such that a first slot is formed therebetween, the lower support wall being spaced apart from the wire organizer such that a second slot is formed therebetween, a first set of the wires extending from the wire channels across the first slot to the upper support wall, a second set of the wires extending from the wire channels across the second slot to the lower support wall;

wherein the top cutting blade is positioned in the first slot and the bottom cutting blade is positioned in the second slot, the top cutting blade trimming the first set of wires as the front and rear housings are mated, the bottom cutting blade trimming the second set of wires as the front and rear housings are mated, the first and second sets of wires being terminated to the contacts when the front and rear housings are mated.

11. The electrical connector of claim 10, wherein each of the first set of wires is supported along two different lengths thereof by the wire channels and the upper support wall, respectively, the top cutting blade trimming the wires between the two supported lengths of the wires, and wherein each of the second set of wires is supported along two different lengths thereof by the wire channels and the lower support wall, respectively, the bottom cutting blade trimming the wires between the two supported lengths of the wires.

12. The electrical connector of claim 10, wherein each wire has a first portion and a second portion, the second portion being defined between the first portion and a distal end of the wire, the first portion being supported by the corresponding wire channel against movement in a rearward direction, the second portion being supported by the corresponding upper or lower support wall against movement in the rearward direction, the second portion being trimmed by the corresponding top or bottom cutting blade and removed from the first portion when the front and rear housings are mated.

13. The electrical connector of claim 10, wherein the rear housing has a top, a bottom, and opposite first and second sides, the rear housing having a width defined between the sides, the upper and lower support walls each having different widths, at least one of the widths of the upper and lower support walls being different than the width of the rear housing.

14. The electrical connector of claim 10, wherein the upper and lower support walls define an exterior surface of the electrical connector, the upper and lower support walls being size differently and being received in top and bottom channels, respectively, formed in the front housing, the upper and lower support walls and the top and bottom channels define polarizing features that orient the rear housing with respect to the front housing.

15. An electrical connector comprising:

a front housing holding a plurality of contacts, the front housing holding a cutting blade proximate to a rear of the front housing; and a rear housing having a central opening configured to receive a multi-wire cable therethrough along a cable axis, the rear housing having an inner support wall and an outer support wall positioned along a front of the rear housing, the outer support wall being spaced apart from, and radially outward of, the inner support wall such that a slot is created between the inner and outer support walls, individual wires of the cable extending across the slot such that each wire is supported on a rear surface thereof by both the inner and outer support walls;

wherein the cutting blade is positioned in the slot, the cutting blade being configured to trim the wires between the inner and outer support walls, the contacts being configured to be terminated to the wires when the front housing and the rear housing are mated.

16. The electrical connector of claim 15, wherein the wires enter the rear housing through the central opening along the cable axis and the wires are bent about the front of the rear housing such that the wires extend generally perpendicular to the cable axis.

17. The electrical connector of claim 15, wherein the rear housing includes a wire organizer at the front of the rear housing, the wire organizer having a plurality of wire channels that receive corresponding wires therein, the wire channels extend generally perpendicular to the cable axis and include an outer end, the outer ends of the wire channels defining the inner support wall for the wires.

18. The electrical connector of claim 15, wherein the wire is supported along two different lengths of the wire by the inner support wall and the outer support wall, respectively, the cutting blade trimming the wire between the two supported lengths of the wire.

19. The electrical connector of claim 15, wherein the outer support wall supports a distal end of each wire against rearward movement in a rearward direction parallel to the cable axis.

20. The electrical connector of claim 15, wherein each wire has a first portion and a second portion, the second portion being defined between the first portion and a distal end of the wire, the first portion being supported by the inner support wall against rearward movement in a rearward direction parallel to the cable axis, the second portion being supported by the outer support wall against rearward movement in the rearward direction, the second portion being trimmed by the cutting blade and removed from the first portion when the front and rear housings are mated.

* * * * *